US005162704A

United States Patent [19]

Kobori et al.

[11] Patent Number: 5,162,704

[45] Date of Patent: Nov. 10, 1992

[54] FIELD EMISSION CATHODE

[75] Inventors: Yoichi Kobori; Mitsuru Tanaka, both of Mobara, Japan

[73] Assignee: Futaba Denshi Kogyo K.K., Mobara, Japan

[21] Appl. No.: 831,443

[22] Filed: Feb. 5, 1992

[30] Foreign Application Priority Data

Feb. 6, 1991 [JP] Japan ..... 3-034995

[51] Int. Cl.[5] ..... H01J 17/36; H01J 1/02

[52] U.S. Cl. ..... 315/349; 315/169.1; 313/309; 313/336

[58] Field of Search ..... 315/349, 169.1, 169.4; 313/309, 336, 351

[56] References Cited

U.S. PATENT DOCUMENTS

| | | | |
|---|---|---|---|
| 3,755,704 | 8/1973 | Spindt et al. | 313/309 |
| 3,998,678 | 12/1976 | Fukase et al. | 313/336 X |
| 4,008,412 | 2/1977 | Yijito et al. | 313/309 |
| 4,163,918 | 8/1979 | Shelton | 313/309 |
| 4,721,885 | 1/1988 | Brodie | 313/576 |
| 4,901,028 | 2/1990 | Gray et al. | 330/54 |
| 5,075,595 | 12/1991 | Kane | 315/169.1 |

OTHER PUBLICATIONS

Sealed Vacuum Devices: Fluorescent Microtip Displays, by A. Ghis, R. Meyer, P. Ramband, F. Levy, and T. Leroux, IEEE Transactions on Electron Devices, vol. 38, No. 10, pp. 2320–2322, Oct. 1991.

*Primary Examiner*—Eugene R. LaRoche
*Assistant Examiner*—Son Dinh
*Attorney, Agent, or Firm*—Oblon, Spivak, McClelland, Maier & Neustadt

[57] ABSTRACT

A field emission cathode capable of permitting a voltage required for starting emission of electrons from the emitters to be decreased and the emission to be rendered uniform. The field emission cathode includes cathode electrodes formed on a substrate. On each of the cathode electrodes are arranged a plurality of emitters through diodes each acting as a constant-current element, and gate electrodes are arranged above the emitters. Arrangement of the diodes between the emitters and the cathode electrode permits a drive voltage to be reduced as compared with arrangement of a resistive layer therebetween, because a diode is generally decreased in voltage drop as compared with the resistive layer. Also, the arrangement renders emission of electrons from each of the emitters uniform.

5 Claims, 2 Drawing Sheets

FIELD EMISSION CATHODE

BACKGROUND OF THE INVENTION

This invention relates to a field emission cathode (hereinafter also referred to as "FEC"), and more particularly to a field emission cathode useful as an electron source for various kinds of equipments such as a display device, a microwave vacuum tube, a light source, an amplification element, a high-speed switching element, a sensor and the like.

A so-called vertical type field emission cathode which is one example of a field emission cathode is generally constructed as shown in FIG. 5. More particularly, the vertical type field emission cathode includes an insulating substrate 100 made of glass or the like and a cathode electrode 101 arranged on the substrate 101. On the cathode electrode 101 is a resistive layer 102 made of a silicon film or the like, and an insulating layer 103 made of $SiO_2$ or the like is then provided on the resistive layer 102. The insulating layer 103 is formed with cavities 104 and a gate 105 is arranged on the insulating layer 103. The resistive layer 102 is provided on each of portions thereof positionally corresponding to the cavities 104 with an emitter 106 of a cone-like shape, which is connected through the resistive layer 102 to the cathode electrode 101 on the substrate 100.

In the conventional field emission cathode constructed as described above, when the application of a bias voltage of a suitable level to the gate 105 in relation to the emitters 106 causes an electric field to be produced between a tip end of each of the emitters 106 and the gate 105, so that electrons may be emitted from the tip end of the emitter.

In general, a vertical type field emission cathode often causes a large amount of pulse current to flow through emitters due to a failure or deterioration in insulation instantaneously when a switch is closed for starting the FEC, resulting in the emitters being damaged. The conventional vertical type field emission cathode constructed as described above does not lead to short-circuiting because the resistive layer 102 for current restriction is provided between the emitters 106 and the cathode electrode 101, to thereby effectively prevent occurrence of voltage drop sufficient to cause the emission of electrons from the emitters adjacent thereto to be deteriorated.

Nevertheless, the conventional field emission cathode including the resistive layer for current restriction has the following problems.

First, the resistive layer causes voltage drop as high as 10%, so that it is required to increase a drive voltage correspondingly. In other words, the conventional field emission cathode fails to reduce a drive voltage, because voltage drop in the resistive layer causes a waste of the drive voltage.

Also, the emitters are varied in electron emission efficiency from one another. Although the resistive layer somewhat restrains such variation, such restraint is insufficient, resulting in the variation deteriorating uniformity of luminance.

SUMMARY OF THE INVENTION

The present invention has been made in view of the foregoing disadvantages of the prior art.

Accordingly, it is an object of the present invention to provide a field emission cathode which is capable of permitting a voltage required for starting emission of electrons from emitters to be decreased and the emission to be rendered uniform.

In accordance with the present invention, a field emission cathode is provided. The field emission cathode comprises an insulating substrate, cathode electrodes arranged on the substrate, constant-current elements provided on the substrate, and emitters arranged on the substrate and connected through the constant-current elements to the cathode electrodes.

The field emission cathode of the present invention constructed as described above permits a drive voltage to be reduced, because the constant-current element arranged between each of the emitters and the cathode electrode significantly decreases voltage drop as compared with the resistive layer incorporated in the conventional field emission cathode. Also, Such construction permits the emission of electrons from the emitters to be uniformed.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a field emission cathode according to the present invention will be described hereinafter with reference to FIGS. 1 to 4.

Figure 1:
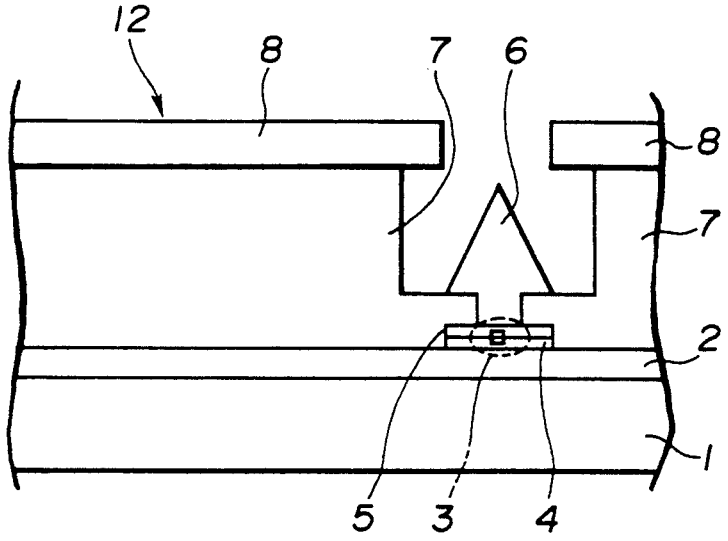
FIG. 1 is a sectional view showing an embodiment of a field emission cathode according to the present invention.
Figure 2:
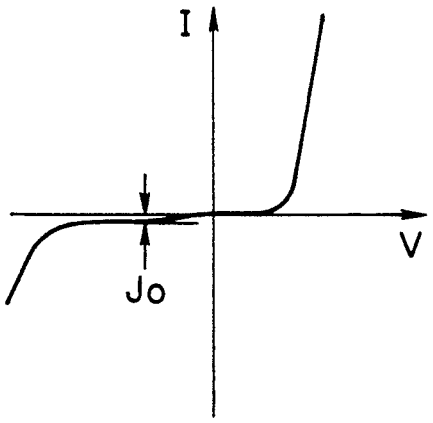
FIG. 2 is a graphical representation showing operation of the field emission cathode of FIG. 1.

FIGS. 1 and 2 illustrate an embodiment of a field emission cathode according to the present invention. A field emission cathode of the illustrated embodiment, as shown in FIG. 1, includes an insulating substrate 1 made of glass or the like and strip-like cathode electrodes 2 made of aluminum or the like and arranged on the substrate 1. On each of the cathode electrodes 2 are formed diodes 3 each acting as a constant-current element. The diodes 3 each comprise a metal layer 4 made of gold and a semiconductor layer 5 made of amorphous silicon.

In the illustrated embodiment, each of the diodes 3 is formed using gold which exhibits good adhesive properties with respect to amorphous silicon. Alternatively, it may be formed by directly joining the semiconductor layer 5 and cathode electrode 2 to each other.

The cathode electrodes 2 each are also formed thereon with an insulating layer 7, which is made of $SiO_2$ and provided with holes. The diodes 3 each are formed thereon with an emitter 6 of a cone-like shape in the vicinity of each of the holes of the insulating layer 7. Also, strip-like gate electrodes 8 are arranged on the insulating layers 7 in a manner to be positioned around the emitters 6. The cathode electrodes 2 and gate electrodes 8 are arranged perpendicular to each other in a matrix-like manner.

Now, the manner of operation of the field emission cathode of the illustrated embodiment constructed as described above will be described hereinafter.

When a voltage is selectively applied to the cathode electrodes 2 and gate electrodes 8, electrons are emitted from a tip end of each of the emitters 6 toward an anode electrode (not shown) having a positive voltage applied thereto. When the embodiment is so constructed that a phosphor layer is deposited on the anode conductor, this permits the phosphor layer to emit light, resulting in a desired display being carried out. In general, a current flowing through the diode is as shown in FIG. 2.

The present invention is featured in that characteristics of a reverse current $J_O$ of the diode shown in FIG. 2 or a leakage current of the diode is utilized.

A difference in activity between the emitters 6 causes the amount of electrons emitted from each of the emitters 6 to be varied. However, the diode acting as a constant-current element which is provided corresponding to each of the emitters functions to render a current flowing therethrough to be substantially constant, so that the emitters 6 may emit the substantially same amount of electrons. Accordingly, even when a plurality of field emission cathodes each constructed according to the present invention are arranged over a wide area, the amount of electrons emitted from each of the emitters may be rendered uniform. In particular, use of the field emission cathode of the present invention for a display device permits a variation in luminance to be significantly reduced.

Figure 3:
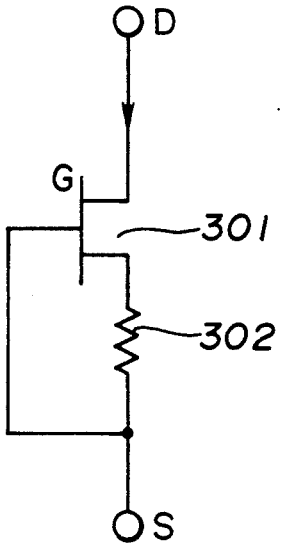
FIG. 3 is a circuit diagram showing an essential part of another embodiment of a field emission cathode according to the present invention.

FIG. 3 shows another embodiment of a field emission cathode according to the present invention. The embodiment shown in FIG. 2 uses the diode as a constant-current element. In the embodiment of FIG. 3, a constant-current element comprises an FET (field effect transistor) 301 and a resistor 302, which may be formed between a cathode electrode (not shown) and an emitter (not shown) which may be constructed in the same manner as the cathode electrode 2 and emitter 6 in the field emission cathode shown in FIG. 1, respectively. More particularly, a terminal S of the resistor 302 is joined to the cathode electrode and a terminal D of the FET 301 is joined to the emitter. This causes an increase in current flowing through the resistor 302 to lower a gate voltage, to thereby reduce a current flowing through the resistor 302. On the contrary, when the current flowing through the resistor 302 is decreased, the gate voltage is increased to increase the current flowing through the resistor 302. The above-described operation permits constant-current characteristics to be exhibited.

Figure 4:
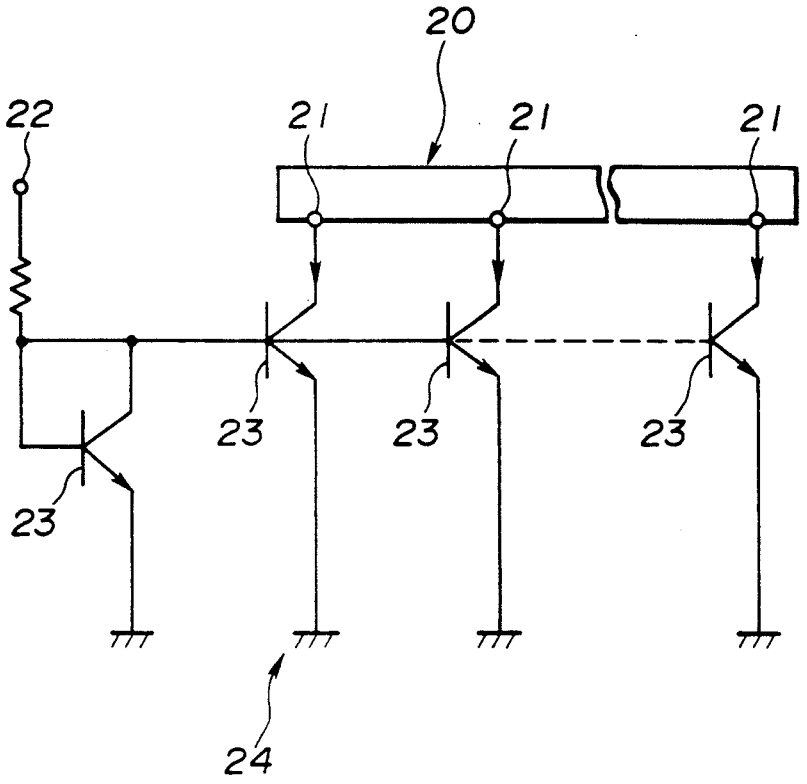
FIG. 4 is a circuit diagram showing an essential part of a further embodiment of a field emission cathode according to the present invention.
Figure 5:
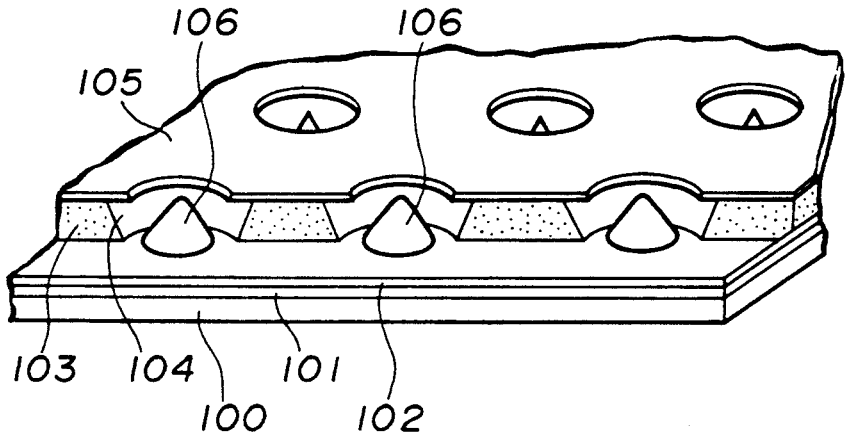
FIG. 5 is a partly cutaway perspective view showing an example of a conventional field emission cathode.

FIG. 4 shows an essential part of a further embodiment of a field emission cathode according to the present invention, wherein a field emission cathode is generally designated at reference numeral 20. In the illustrated embodiment, a constant-current element arranged between each of emitters 21 and a cathode electrode 22 comprises a constant-current circuit 24 constructed using a transistor 23. Thus, it will be noted that the illustrated embodiment exhibits substantially the same function and advantage as in the above-described embodiments.

In each of the above-described embodiments, the constant-current elements each are formed with one such emitter. Alternatively, two or more such emitters may be formed for each of the constant-current elements. Such arrangement, even when the electron emitting capability of one of the emitters is deteriorated, permits the remaining emitter to compensate for the deterioration.

As can be seen from the foregoing, the field emission cathode of the present invention is so constructed that the constant-current elements are arranged between each of the cathode electrodes and the emitters on the insulating substrate. Such construction permits a voltage required for starting emission of electrons from the emitters to be decreased and the emission to be rendered uniform.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A field emission cathode comprising:

an insulating substrate;

cathode electrodes arranged on said substrate;

constant-current elements provided on said substrate;

emitters arranged on said substrate and connected through said constant-current elements to said cathode electrodes;

insulating layers formed on said cathode electrodes having holes in the vicinity of said emitters; and gate electrodes arranged on said insulating layers in a manner to be positioned around said emitters.

2. A field emission cathode as defined in claim 1, wherein said constant-current elements comprise diodes including metal layers made of gold and semiconductor layers made of amorphous silicon.

3. A field emission cathode as defined in claim 2, wherein said diodes are formed by directly joining semiconductor layers and said cathode electrodes to each other.

4. A field emission cathode as defined in claim 1, wherein said constant-current element comprises a field effect transistor and a resistor formed between said cathode electrode and said emitter.

5. A field emission cathode as defined in claim 1, wherein said constant-current element comprises a constant-current circuit constructed using a plurality of transistors.

* * * * *